United States Patent [19]

Lovato

[11] Patent Number: 4,633,549

[45] Date of Patent: Jan. 6, 1987

[54] RELEASABLE BUCKLE PARTICULARLY FOR BAGS, SATCHELS AND SIMILAR ARTICLES

[75] Inventor: Attilio Lovato, Pino Torinese, Italy

[73] Assignee: ITW Fastex Italia S.p.A., Torino, Italy

[21] Appl. No.: 738,636

[22] Filed: May 29, 1985

[30] Foreign Application Priority Data

Jun. 1, 1984 [IT] Italy ..... 67564 A/84

[51] Int. Cl.[4] ..... A44B 11/25

[52] U.S. Cl. ..... 24/615; 24/629

[58] Field of Search ..... 24/614, 615, 616, 618, 24/625, 589, 588, 604, 627, 687, 688, 690, 696, 629

[56] References Cited

U.S. PATENT DOCUMENTS

| | | | |
|---|---|---|---|
| 432,938 | 7/1890 | Hamburger | 24/618 |
| 1,675,787 | 7/1928 | Carr | 24/690 X |
| 2,346,887 | 4/1944 | Winkler | 24/618 |
| 3,596,953 | 8/1971 | Gastaldi | 24/615 X |
| 4,001,924 | 1/1977 | Bengtsson | 24/696 X |
| 4,110,873 | 9/1978 | Verchere | 24/615 |
| 4,296,531 | 10/1981 | Bengtsson | 24/615 X |

FOREIGN PATENT DOCUMENTS

| | | | |
|---|---|---|---|
| 730372 | 8/1932 | France | 24/618 |
| 121388 | 12/1918 | United Kingdom | 24/687 |
| 990008 | 4/1965 | United Kingdom | 24/615 |

*Primary Examiner*—Kenneth J. Dorner
*Assistant Examiner*—James R. Brittain
*Attorney, Agent, or Firm*—A. J. Brunett; T. W. Buckman

[57] ABSTRACT

Buckle on which a female part having a receiving opening at one end and an adjacent locking edge on the opposite side to the opening, and a male part, having a locking portion and an activating portion, are designed to connect in releasable manner; the buckle being characterised by the fact that the locking and activating portions are formed on an intermediate portion and the free end respectively of a flexible tongue projecting from the male part in the insertion direction, the flexible tongue being connected to a further essentially-rigid contrasting tongue on the male part, the distance between the tongue and the locking portion on the flexible tongue being greater than the height of the receiving opening.

9 Claims, 5 Drawing Figures

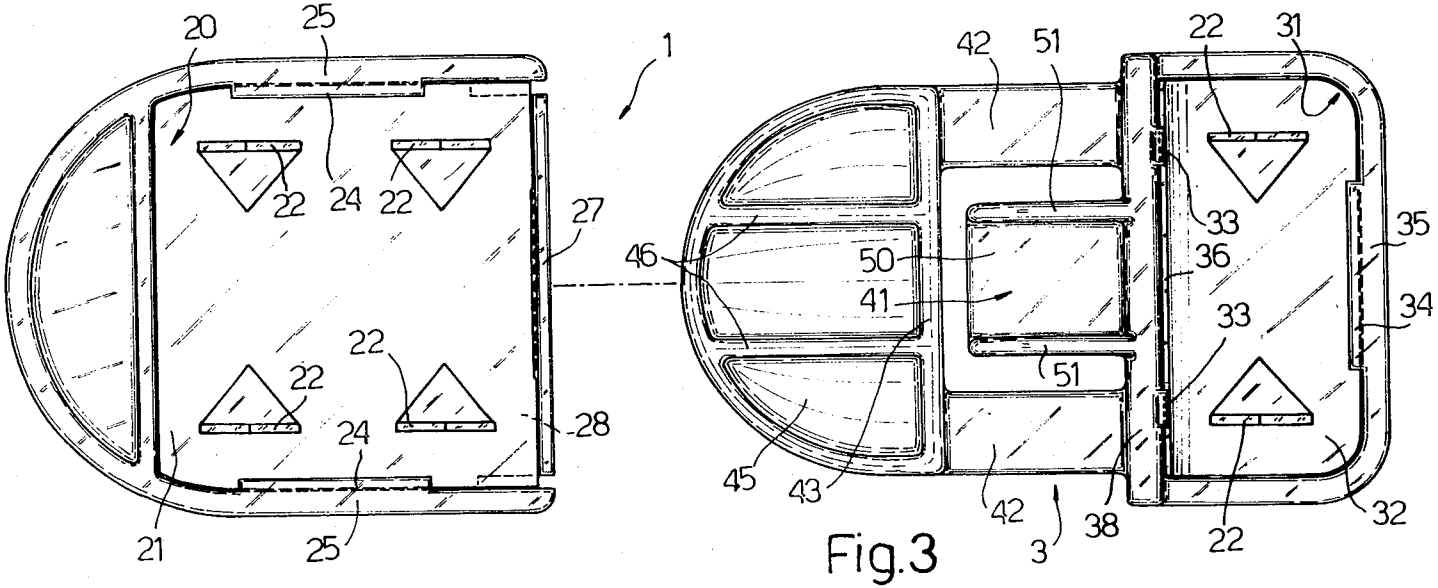
Fig.3
Fig.4
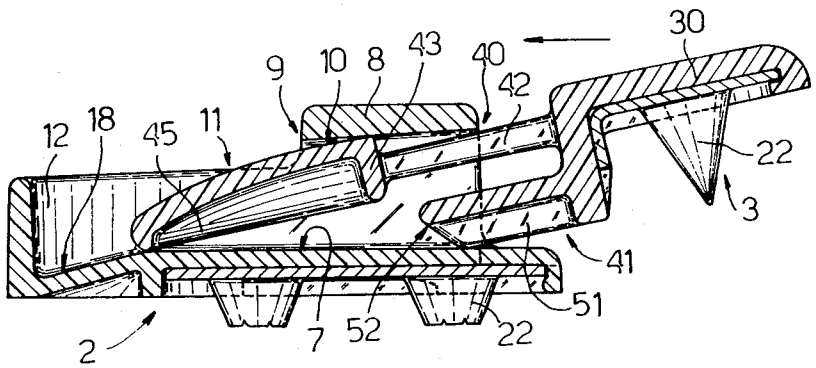

RELEASEABLE BUCKLE PARTICULARLY FOR BAGS, SATCHELS AND SIMILAR ARTICLES

BACKGROUND OF THE INVENTION

The present invention relates to a releasable buckle, particularly for bags, satchels and similar, the said buckle comprising an essentially-plate-like female part, the latter having a receiving opening at one end and an adjacent locking edge on the opposite side to the said receiving opening, and a male part comprising a locking portion, the latter engaging behind the locking edge when the male part is inserted inside the said receiving opening, and an activating portion located in front of the locking portion in the male part insertion direction. On known buckles of the aforementioned type, the activating and locking portions are formed respectively on the root portion and free end of a flexible tongue carried on the front end and facing the rear end of the male part, in the insertion direction of the latter inside the female part. The said male part is essentially a rigid plate having the said flexible tongue at one end and, at the opposite end, a member enabling connection to sheet material such as a belt or the flap on a bag or satchel. One of the main drawbacks on known buckles of the aforementioned type is that, for locking and releasing the male part inside the female part, the said flexible tongue is required to deflect considerably for enabling the locking portion on the said free end of the said flexible tongue to fit underneath the said locking edge and so enable passage of the same through the said receiving opening. Such entails relatively strong effort on the part of the user, relatively slow operation with the possibility of the buckle getting jammed, particularly when opened, and the danger of the flexible tongue being broken and the buckle thus being rendered unusable, owing to severe fatigue caused by the relatively severe bending strain the buckle is subjected to.

SUMMARY OF THE INVENTION

The aim of the present invention is to provide a releasable buckle of the aforementioned type involving none of the aforementioned drawbacks, i.e. one providing for fast locking and, particularly, fast release, that is strong and cheap to make, and which requires very little effort on the part of the user.

With this aim in view, the present invention relates to a buckle comprising an essentially-plate-like female part, the latter having a U-shaped bracket on its upper surface, and a male part separable from the female part; the said female part having, towards one end, an opening, for receiving the said male part, and an adjacent locking edge on the opposite side to the said opening, both being defined by the said U bracket; and the said male part comprising a locking portion, engaging behind the said locking edge when the male part is inserted inside the receiving opening, and an activating portion located in front of the said locking portion in the male part insertion direction; characterised by the fact that the said locking and activating portions on the said male part are both formed on an intermediate portion and the free end respectively of a flexible tongue projecting from the said male part in the insertion direction of the same; the said male part also comprising an essentially-rigid contrasting tongue projecting beneath the said flexible tongue and essentially beneath the said locking portion, the lower surface of the said rigid tongue being located, in relation to the said locking portion, at a distance, measured perpendicularly to the planes of the said rigid and flexible tongues, greater than the height of the said receiving opening, in such a manner as to determine, in conjunction with the said upper surface of the female part, slanting insertion of the male part inside the said receiving opening.

BRIEF DESCRIPTION OF THE DRAWINGS

A non-limiting arrangement of the present invention will now be described with reference to the attached drawings in which:

FIG. 3 shows a bottom plan view of the FIG. 1 buckle;

FIG. 4 shows a stage in the operation of the buckle according to the present invention;

DETAILED DESCRIPTION OF THE INVENTION

Figure 1:
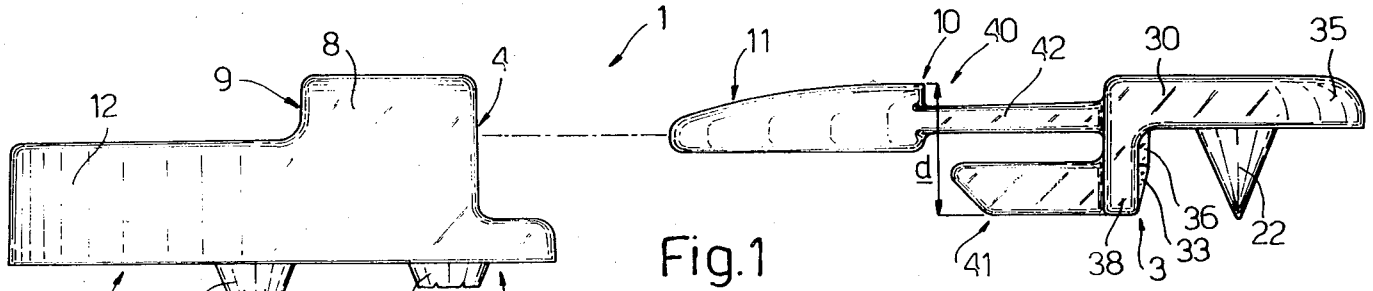
FIG. 1 shows an exploded longitudinal view of the buckle according to the present invention.
Figure 2:
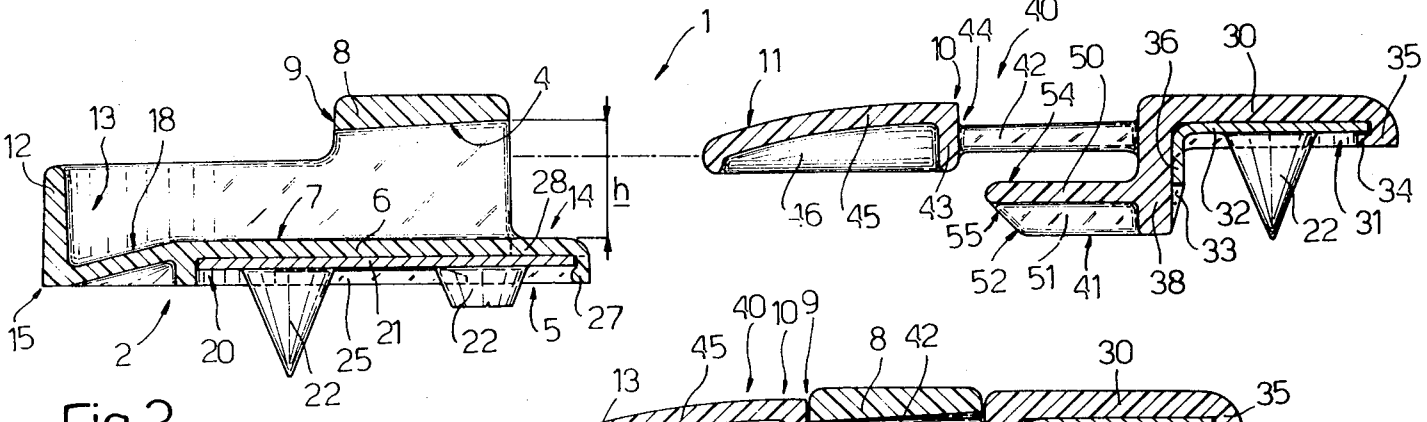
FIG. 2 shows a longitudinal section of the FIG. 1 buckle.
Figure 5:
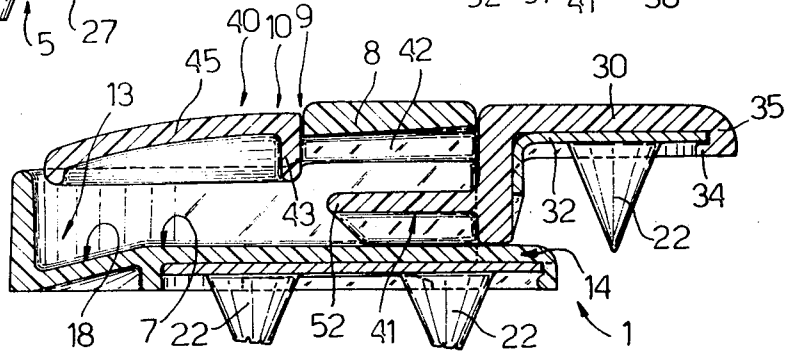
FIG. 5 shows a longitudinal section of the buckle according to the present invention in the locked position.

Number 1 in FIGS. 1 to 3 indicates a releasable buckle, particularly suitable for locking bags, satchels or similar and comprising a female part 2 and a male part 3, the latter being separable from the said female part and designed to connect with the same by insertion inside a receiving opening 4 formed on end 5 of the said female part 2. The latter comprises an essentially-flat plate 6 having, on its upper surface 7, a U-shaped bracket 8 formed integral with plate 6 and defining, on end 5, the said receiving opening 4, and, on the opposite side, a locking edge 9 adjacent to opening 4 and against which engages, in the locked position (FIG. 5), a respective locking portion 10, on the said male part 3, located behind a respective activating portion 11 on the said male part 3 in the insertion direction of male part 3 inside female part 2. According to the present invention, female part 2 presents a raised collar edge 12, the latter defining with surface 7 a cup-shaped housing 13 for the said activating 11 and locking 10 portions on male part 3, and a projecting portion 14 located in front of opening 4 in the insertion direction of male part 3. On end 15 opposite end 5 on female part 2, surface 7 presents a sloping portion 18 sloping downwards in the insertion direction of male part 3 and designed to receive activating portion 11 when male part 3 is inserted inside female part 2, as shown clearly in FIG. 4. Again according to the present invention, U bracket 8 is flared internally on its upper side in such a manner as to widen opening 4 on the opposite side to locking edge 9. For reasons of appearance, end 15 is preferably shaped in the arc of a circle. Flat plate 6 presents an essentially-rectangular bottom recess 20 housing a suitably thick metal plate 21 having respective cutting and locking tabs 22, the latter being preferably triangular in shape and designed to pierce any type of sheet material, e.g. leather or natural/synthetic fabric, for enabling assembly on the same of female part 2. Plate 6 thus defines, at the bottom, a connecting member for connecting part 2 to the said sheet material constituting, for example, a strap, belt or flap on a bag or satchel to which buckle 1 may be fitted. Tabs 22 are preferably formed by half-blanking plate 21, project perpendicularly from the same, outwards of recess 20, and are designed to bend 90° after piercing the said sheet material, in such a manner as to secure part 2 to the same. Plate 21 is clicked on to part 2 inside recess 20, the latter being defined, according to the present invention, by a pair of essentially-rigid, longitudinal ridges 24 (FIG. 3) arranged facing each other and formed along opposite longitudinal edges 25 of plate 6, and by a front tooth 27 formed, on the end 5 side, on the free end of a flexible tongue 28 formed integral with female part 2 and projecting from the U bracket 8 side, in such a manner as to define, together with the end part of opposite edges 25, the said projecting portion 14. Tongue 28 defines, at the bottom, receiving opening 4 and is designed to deflect in such a manner as to enable insertion of plate 21 underneath tooth 27, after first sliding the said plate 21 inside recess 20 underneath longitudinal ridges 24.

According to the present invention, male part 3 also presents a connecting member 30, the latter being L-shaped and having a housing 31 at the bottom for receiving a suitably thick L-shaped metal plate 32 having cutting tabs 22, identical to those on plate 21, and clicked inside housing 31 by means of lock ridges 33 and 34 defining housing 31. Lock ridge 34, being formed on edge 35 of member 30, is also deflectable so as to enable plate 32 to be simply pressed underneath it, after first placing end 36 on plate 32 against ridges 33 which are preferably two in number and formed on a further edge 38 opposite edge 35 on member 30. The latter therefore also provides for securing the male part 3 to a corresponding portion of sheet material, which may then be secured, via buckle 1, to the corresponding portion of sheet material secured integral with female part 2.

According to the present invention, L-shaped member 30 is wider than opening 4, so as to contact U bracket 8, when parts 2 and 3 are connected (FIG. 5), and so lock part 3 axially in relation to part 2 in the insertion direction, and is provided integrally with a pair of projecting longitudinal tongues 40 and 41, the former arranged over the latter. Tongue 40 is deflectable and, according to the present invention, is fitted with the said activating 11 and locking 10 portions of male part 3, whereas tongue 41 is essentially rigid, designed to cooperate with projecting portion 14 and surface 7, and acts as a contrasting tongue for flexible tongue 40. According to the present invention, and unlike known buckles, activating portion 11 is formed on the free end of tongue 40, whereas locking portion 10 is formed essentially on the intermediate portion of the said tongue 40, the latter, according to the non-limiting arrangement shown, being essentially frame-like and comprising two flexible, parallel side members 42, arranged side by side over tongue 41, and a cross member 43 connecting the ends of side members 42 and having, on the side facing member 30, an edge 44 projecting perpendicularly in relation to side members 42 and defining the said locking portion 10, and, on the opposite side, an essentially-rigid projecting push-button 45 having strengthening ribs 46, being shaped, for reasons of appearance, essentially in the arc of a circle so as to match the contour of end 15 on part 2, and defining activating portion 11. Edge 44 is designed to cooperate with and engage behind edge 9 when male part 3 is inserted inside opening 4, in which arrangement, button 45 closes off the top of housing 13. Essentially-rigid tongue 41, on the other hand, presents an essentially-U-shaped cross section and comprises an essentially-flat top part 50, the latter arranged facing the opening which is thus defined by side members 42, member 30 and cross member 43, and a pair of opposed longitudinal strengthening ribs 51 designed to cooperate in sliding manner with surface 7 in such a manner as to keep flexible tongue 40 against the top portion of bracket 8 when parts 2 and 3 are connected. According to the present invention, tongue 41 presents an inclined, radiused free end 52 defined by a pair of adjacent surfaces 54 and 55 combining to form an acute angle and amply radiused to invite insertion of male part 3 inside opening 4, the said tongue 41 being of such a length that free end 52 lies essentially below locking portion 10. According to the present invention, tongues 40 and 41 are arranged in such a manner that the distance, indicated by d in FIG. 1, between the bottom surface of tongue 41, defined by the bottom faces of ribs 51, and portion 10, measured perpendicularly to the planes of tongues 40 and 41, is greater than the height of receiving opening 4, indicated by h in FIG. 2. In use, parts 2 and 3 are secured, in known manner (not shown) using bendable tabs 22, to respective known sheet materials (not shown) consisting, for example, of the two ends of a belt or the two parts of the closing portion on a bag or school satchel. Male part 3 is inserted inside female part 2 and buckle 1 locked by bringing male part 3 up to opening 4, to be more precise, by placing tongues 40 and 41 against end 5. Owing to the distance between tongues 40 and 41, end 52 on the latter cooperates with projecting portion 14 in such a manner as to produce, on account of the inclined surface defined by surfaces 54 and 55, an upward movement of part 3 as the latter is inserted, in the direction shown by the arrow in FIG. 4, inside part 2, thus bringing part 3 into the slanting position shown in FIG. 4. This partial locking position of buckle 1 is only made possible by distance d between portion 10 and the bottom surface of tongue 41 being greater than the height h of opening 4, by the special design of part 2 and, in particular, by slanting portion 18 on surface 7 and the flare on opening 4 itself. Furthermore, with buckle 1 in the said partially-locked position, tongue 40 is in no way stressed, owing to the fact that portion 10 simply slides along the flared inner face of bracket 8, whereas tongue 41 cooperates with surface 7 despite the fact that, as shown clearly in FIG. 4, in the said partially-locked position, activating portion 11 is already fairly well inserted inside housing 13. Clearly, therefore, starting from the position shown in FIG. 4, all the user has to do is push male part 3 gently forward in the sloping insertion direction to cause, with only slight bending of tongue 40, portion 10 to click behind locking edge 9 so as to reposition male part 3 parallel with surface 7. Vice versa, for releasing buckle 1, all the user has to do is push activating portion 11 gently towards surface 7 to cause, together with slight bending of tongue 40, the entire male part 3 to turn on tongue 41 and push-button 45 to move towards slanting surface 18. As soon as the said surface is reached by push-button 45, locking portion 10 is released, i.e. edge 44 is released from locking edge 9, while at the same time, owing to the slope on surface 18, male part 3 is expelled through opening 4, due to the fact that, during release, male part 3 assumes the same intermediate sloping position already examined in FIG. 4.

The advantages of the buckle according to the present invention will be clear from the foregoing description. In particular, its special design provides for inserting most of male part 3 inside female part 2 with only a very slight deflection of tongue 40, thanks to the sloping position assumed by male part 3 during insertion owing to the presence of additional rigid tongue 41 and the special design of female part 2. Such an arrangement provides for fast, reliable insertion and, more especially, for immediate release, in that all the user has to do is press gently on portion 10 to cause male part 3 to be expelled automatically on account of the elastic reaction exchanged obliquely, in relation to female part 2, between surface 18 and tongue 40. Furthermore, the special design of buckle 1 according to the present invention eliminates any possibility of it jamming either when locked or released. Finally, the limited amount of deflection required of flexible tongue 40 ensures reduced strain on the said tongue and long working life of the buckle itself.

To those skilled in the art it will be clear that changes may be made to the buckle as described and illustrated herein without, however, departing from the scope of the present invention.

I claim:

1. A buckle comprising: an essentially plate-like female part having a U-shaped bracket on its upper surface and a male part separable from the female part; said female part including a receiving cavity having towards one end an opening for receiving said male part, an adjacent locking edge on the opposite side of the said opening, both said opening and said locking edge being defined by said U-shaped bracket, and a slanting ramp portion comprising a portion of the inside surface of said cavity sloping downwards away from said U-shaped bracket in the male part insertion direction; said male part having a locking portion engaging behind said locking edge when said male part is inserted inside said receiving opening and an activating portion located in front of said locking portion in the male part insertion direction; said male part further having said locking and said activating portions formed on an intermediate portion and the free end respectively of a first flexible tongue projecting from said male part in the direction of its insertion; said male part also having a second essentially rigid contrasting tongue projecting beneath said first flexible tongue and essentially beneath said locking portion, the lower surface of said second rigid tongue being located, in relation to said locking portion, at a distance measured perpendicularly to the planes of said second rigid and first flexible tongues, greater than the height of said receiving opening; wherein said activating portion of said male part cooperates with said receiving opening and said ramp portion of said female part for insertion and retention therein.

2. A buckle according to claim 1, wherein said U bracket is flared internally on its top side in such a manner as to widen said receiving opening on the opposite side of said locking edge.

3. A buckle according to claim 1, wherein said female part is provided with a raised collar edge defining, together with said top surface, a cup-shaped housing for said activating and locking portions.

4. A buckle according to claim 1, wherein said male and female parts include respective flat plate members enabling connection to sheet material, such as a belt, a bag flap or similar articles.

5. A buckle according to claim 4, wherein each respective plate member on said male and female parts comprises a metal plate having respective cutting and locking tabs designed to pierce said sheet material and to bend 90°, and means upon said male and female parts for engaging said metal plates on to said male and female parts.

6. A buckle according to claim 5, wherein said male part includes an L-shaped connecting member formed integral with said flexible and rigid tongues and having a housing on its bottom for engaging a respective L-shaped metal plate, said housing being defined by respective lock ridges for receiving said L-shaped metal plate of which at least one of said ridges is deflectable.

7. A buckle according to claim 4, wherein said female part includes a bottom recess housing a corresponding metal plate, said recess being defined by a respective pair of opposed longitudinal ridges and by a front tooth formed on the free end of a deflecting tongue integral with said female part and projecting from said U bracket side, said tongue defining the bottom of the said receiving opening.

8. A buckle according to claim 1, wherein said female part includes a projecting portion in front of said receiving opening in the male part insertion direction, which cooperates with said rigid tongue wherein said rigid tongue has a free end defined by respective adjacent surfaces which combine to form an acute angle and are radiused in such a manner as to allow insertion of said male part inside said receiving opening.

9. A buckle according to claim 1, wherein said flexible tongue on said male part is essentially frame-like and comprises two flexible, longitudinal side members arranged side by side and parallel over said rigid tongue and a cross member connecting said side members and having, on one side, an edge designed to cooperate with said locking edge of said female part and defining said locking portion and, on the other side, a projecting push-button defining said activating portion.

* * * * *